US005710427A

United States Patent [19]

Schubert et al.

[11] Patent Number: 5,710,427

[45] Date of Patent: Jan. 20, 1998

[54] METHOD FOR CONTROLLING THE ION GENERATION RATE FOR MASS SELECTIVE LOADING OF IONS IN ION TRAPS

[75] Inventors: Michael Schubert; Jochen Franzen, both of Bremen, Germany

[73] Assignee: Bruker-Franzen Analytik GmbH, Bremen, Germany

[21] Appl. No.: 588,059

[22] Filed: Jan. 19, 1996

[30] Foreign Application Priority Data

Jan. 21, 1995 [DE] Germany ..... 195 01 823.0

[51] Int. Cl.[6] ..... H01J 49/42

[52] U.S. Cl. ..... 250/282; 250/292

[58] Field of Search ..... 250/282, 281, 250/288, 292, 291, 290

[56] References Cited

U.S. PATENT DOCUMENTS

| | | | |
|---|---|---|---|
| 4,771,172 | 9/1988 | Weber-Grabau et al. | 250/282 |
| 5,107,109 | 4/1992 | Stafford, Jr. et al. | 250/282 |
| 5,134,286 | 7/1992 | Kelley | 250/282 |
| 5,324,939 | 6/1994 | Louris et al. | 250/292 |
| 5,448,061 | 9/1995 | Wells | 250/282 |
| 5,479,012 | 12/1995 | Wells | 250/282 |
| 5,559,325 | 9/1996 | Franzen | 250/282 |

FOREIGN PATENT DOCUMENTS

| | | |
|---|---|---|
| 0362432 | 4/1990 | European Pat. Off. . |
| 0581600 | 2/1994 | European Pat. Off. . |
| 0630042 | 12/1994 | European Pat. Off. . |
| 2278233 | 11/1994 | United Kingdom . |
| WO9404252 | 3/1994 | WIPO . |

*Primary Examiner*—Jack I. Berman
*Assistant Examiner*—Kiet T. Nguyen

[57] ABSTRACT

A method of mass selective loading of ion traps by ejection of undesirable ion species during the loading process by applying RF voltages with a mixture of frequency components to the trap electrodes. For several mass spectrometric investigations only ions with desired mass-to-charge ratios are to be loaded into the ion trap in order to achieve a more efficient utilization of the limited storage capability of the ion trap. The generation rate of the ions during the loading process in such a way that the equilibrium of the space charge inside the ion trap, balanced between ion generation rate and ion ejection rate, does not significantly deteriorate the mass resolution of the ejection process.

10 Claims, 4 Drawing Sheets

PRESCAN MEASUREMENT
SPECTRUM MEASUREMENT
AMPLITUDE OF DRIVE RF

ION GENERATION PROCESS

EXCITATION WAVEFORM APPLICATION

ION DETECTOR SIGNAL

METHOD FOR CONTROLLING THE ION GENERATION RATE FOR MASS SELECTIVE LOADING OF IONS IN ION TRAPS

The invention relates to a method of mass selective loading of ion traps by ejection of undesirable ion species during the loading process by applying RF voltages with a mixture of frequency components to the trap electrodes. For several mass spectrometric investigations only ions with desired mass-to-charge ratios (m/z) are to be loaded into the ion trap in order to achieve a more efficient utilization of the limited storage capacity of the ion trap.

The invention consists in controlling the generation rate of the ions during the loading process in such a way that the equilibrium of the space charge inside the ion trap, balanced between ion generation rate and ion ejection rate, does not significantly deteriorate the mass resolution of the ejection process.

REFERENCE TO A CONCURRENT PATENT APPLICATION

In U.S. Pat. No. 5,654,542 "Method for exciting the oscillations of ions in ion traps with frequency mixtures" the same subject is addressed as in this patent application. The descriptive text of the referenced patent application is therefore referenced here in full.

PRIOR ART

In ion traps one can resonantly excite the oscillations of ion species with several different mass-to-charge ratios simultaneously in such a manner that they leave the ion trap. Other ion species remain practically unexcited. A particularly important application is the mass selective loading of ions of a specified m/z ratio in the ion trap. Undesirable ions are already ejected from the ion trap during the loading procedure to be able to fully utilize the limited storage capacity of the trap for the desired ions.

The mass selectively stored ions can then be further investigated by various methods. For example, impact or photon fragmentation can be used to generate characteristic daughter spectra which can be utilized to identify or quantify certain ion species. Or characteristic product ion spectra can be generated through reactions with reactant gases.

The loading of ions can be performed either by generating ions inside the trap, e.g. by injecting electrons and simultaneously introducing substance vapors, or by generating ions outside the trap and transferring them to the trap by ion-optical means. In both cases the generation rate of the ions depends on the substance concentration.

As is known from U.S. Pat. No. 4,761,545 (Marshall, Ricca, and Wang), one can resonantly excite the motion of different ions almost simultaneously by applying mixtures of discrete frequencies to the electrodes of the ion traps. With strong excitation, undesired ions can thus be ejected from the ion trap. This is possible both for magnetic Penning ion traps (ion-cyclotron resonance ion traps, ICR) and for Paul RF quadrupole ion traps. In the U.S. patent mentioned, the frequency mixture is generated digitally, stored digitally, and then output to at least one electrode of the ion trap via suitable D/A-converters and post-amplifiers. The frequency mixture is calculated by inverse Fourier transformation from a specified frequency profile, whereby the frequency profile contains the oscillation frequencies of the undesirable ions to be ejected and leaves out, as gaps in the frequency profile, the oscillation frequencies of desired ions to be kept in the ion trap. This process of adding up frequencies to a superimposed mixture needs some care because unfavorable phases of the frequencies can easily create, by interference, an excessively high peak of frequencies in an elsewhere almost empty mixture interval. The patent teaches that the phases of the discrete frequencies have to be chosen as a nonlinear function for consecutive frequencies to limit the dynamic range of mixture amplitudes. Marshall et al. recommend specifically to use a phase function quadratic on the frequency. From a set of amplitude, phase, and frequency values in the frequency domaine by which the frequency profile is presented, a sequence of amplitude values in the time domain is then generated by inverse Fourier transformation. This sequence of amplitude values in the time domaine will be called, in the following, a "mixture waveform" or a "waveform period". The duration of the waveform period depends on the number of values in the frequency domaine. This method has become well-known in the field of ICR mass spectrometry under the acronym "SWIFT" (Stored Waveform by "Inverse Fourier Transformation").

However, for the present case of mass selective loading of ions this method has disadvantages. It essentially generates a brief fast frequency sweep. In the waveform period which is generated by inverse Fourier transformation after Marshall et al. the frequency initially starts oscillating at low frequencies, then essentially passes through increasing frequencies one after the other, and then turns the amplitude down again to zero. Consequently, ions of a given mass are excited only during a very short time span within the entire waveform period. In the remaining time they are practically not excited at all. If one repeats the output of the waveform period signal a number of times in succession, each ion is given a brief excitation pulse in each waveform period, there is no energy transfer to the ions in between, and therefore no ejection of ions takes place in between. However, since during ion generation it is desirable to have continuous ejection of the ions in order to avoid overloading the ion trap, this method is very inadequate for the present purpose, despite its great merits in ICR mass spectrometry.

In EP 362 432 A1 (J. Franzen, R.-H. Gabling) a digitally generated "broadband signal" was proposed for this purpose, which constitutes a mixture of discrete, continuously present frequencies. However, this document provides no information about how the mixture of frequencies can be made in such a way that it matches limited dynamic ranges of values and voltages, as is necessary in amplifiers both for digital presentation and for further electronic processing.

In U.S. Pat. No. 5,324,939 (J. N. Louris, D. M. Taylor) the method proposed by Marshall, Ricca and Wang is optimized by critical selection of the proportionality factor between the phase and square of the frequency, and by comb structuring the amplitudes of adjacent frequencies so that a fairly uniform presence of all the frequencies is said to be achieved. In the U.S. Pat. No. 5,654,542 a detailed opinion is offered as to why the method described in that patent is only apparently better than the method described by Marshall et al.

In U.S. Pat. No. 5,314,286 (P. E. Kelley) a method is described which uses electronic noise for the purpose of ion excitation. By filtering out certain frequencies it is possible to leave ions of selected mass-to-charge ratios unexcited by the noise. This method is much better suited to the purpose of mass selective loading because in principle all the frequencies are continuously present over the entire time of noise, disregarding statistical fluctuations of the individual frequency amplitudes according to frequency and time. The power profile is—again apart from statistical fluctuations by which noise is defined technically—temporally constant However, the patent provides no information about the definition or generation of noise.

PCT/US93/07 092 A1 (P. E. Kelley) describes a method of digitally generating the electronic noise in accordance with U.S. Pat. No. 5,134,286 by adding discrete sine-wave functions, although the concept of "noise" is restricted to descrete frequencies with the same amplitudes and same frequency spacing. By stepwise optimizing the phases of the discrete frequencies a "noise" signal is generated which has a small dynamic range of amplitudes. For each frequency to be added there is a trial process as to which phase produces the smallest enlargement of dynamic range. Filtering can be generated by omitting the relevant frequencies during addition. This method has the disadvantage that the arithmetic process of generating the frequency mixture is highly elaborate. Both the length of the required frequency mixture waveform and the method required for this calculation contribute to computation time.

Due to the special method of electronic generation of the frequency mixture from a digital value sequence according to DE 4 316 737 (J. Franzen, R.-H. Gabling, G. Heinen) the storage requirement for the frequency mixture can be reduced. The fact that the side band structures of the Mathieu equation, which apply to the oscillations of the ions in the RF ion trap, and those of the digital frequency generation agree, allows to dispense the otherwise necessary oversampling. The side bands of the digital frequency generation do not disturb the motion of the ions. This method reduces not only the memory requirement for storing the mixture waveform but also the computation requirement

DISADVANTAGES OF PREVIOUS METHODS AND BASIS OF THE INVENTION

Some of the above methods attempt to distribute the ejection of the ions evenly over the entire ion generation period. They try to not only supply oscillation energy in form of short pulses, as is the case in the method described by Marshall et al. However, the continuous presence of all the frequencies is only one of the prerequisites necessary for effective mass selective loading of ions into an ion trap.

Both for internal generation of ions and for external generation the rate of ion generation depends on substance concentration. In many practical cases, e.g. in the coupling of gas chromatography and mass spectrometry (GC-MS), the concentration of the analysis substance fluctuates considerably; the useful concentrations may cover more than five orders of magnitude. The same is true for the coupling of mass spectrometry with other substance-separating methods, but also in investigating pyrolyric or explosive processes.

From U.S. Pat. No. 5,107,109 (Stafford, Taylor, and Bradshaw) it is already known that it is necessary to control the final number of ions in the ion trap to avoid negative influences of space charge on the process of spectrum scanning. The final number of ions is controlled in all practical applications by controlling the ionization time, although control of the intensity of the ionization process has also been proposed.

The generation of ions until the trap is optimally filled can therefore be of shorter or longer duration depending on the concentration of the analysis substance and, for example, can range from 10 microseconds to 1,000 milliseconds. The process of oscillation excitation to eliminate the undesirable ions must therefore be able to work within and over these time spans. For long ionization periods this may not be a problem; although there is no teaching about this in the patents described above it may be clear to the expert that cyclic repetition of the mixture waveform may be possible under certain conditions.

However, in experiments it has become evident that, for the mass selective loading process of ions, it is by no means adequate to control the final number of ions in the ion trap. Mass selective loading fails completely if the generation rate of the ions is too high compared with the ejection rate. None of the methods which have so far become known takes into account the fact that the equilibrium number of ions formed by a high ion generation rate and a low ion ejection rate can already lead to such a high space charge that the ejection process itself is completely disturbed. The mass resolution of the ejection process, representing the distinguishibility between desired and and undesired ions, is completely destroyed by too high a space charge.

Moreover, the equilibrium space charge develops other detrimental effects. Ions are prevented from further loading if there is already a cloud of ions in the center of the ion trap. This concerns particularly heavy ions in the presence of a cloud of lighter ions because light ions are stored in the center of the cloud but heavier ones at the edge of the cloud. The pseudo potential well of the RF ion trap is shallower for heavy ions than for light ions. For selectively loading heavy ions it is therefore essential to remove the lighter ions from the ion trap continuously and at high speed. Space charge effects thus can cause mass-specific distortion of the loading process of ion traps and prevent quantitative analyses with a good level of accuracy.

OBJECTIVE OF THE INVENTION

A method has to be found to mass selectively load and store, from a non-selectively created mixture of ions, only the desired ion species in an ion trap. By the method of continuous resonant ejection of all undesired ions, which method should work under strong fluctuations in substance concentration resulting in corresponding changes of the ion generation rate.

In particular the method should be suited to load heavy ions in an overwhelming presence of light ions.

BRIEF DESCRIPTION OF THE INVENTION

It is the basic idea of the invention to not only optimize the ejection process of the ions with respect to speed but also to control the generation rate of the ions in such a way that the ion population equilibrium inside the trap never destroys the desired mass resolution for ion ejection. In experiments it has been measured that the maximum allowable ion population during ion generation is about 10 times the value of the maximum population allowable for scanning.

As explained in the U.S. Pat. No. 5,654,542, a lower limit exists for the ejection speed of ions from the ion trap for physical reasons.

The ion population equilibrium inside the ion trap is established by the ion generation rate on the one hand and by the ion ejection rate on the other. (This ejection rate also has to include the ions the ejection of which does not take place due to the frequency mixture but by non-stability in the range below cut-off mass, even if these ions are only in the ion trap for a very short time). In experiments it has been proven that despite optimal ejection of the ions at high generation rates the ion population equilibrium can assume such high values that the mass resolution of the ejection process is greatly deteriorated by space charge effects, and mass selected loading is no longer rendered possible.

In the simplest case the generation rate can be limited in such a manner that for a maximum substance concentration supplied (or maximum substance partial pressure) the limit for the ion population is not exceeded. The mean ejection speed for the ions can be assumed to be constant so that the ejection rate will always be proportional to the generation rate. In GC-MS coupling a maximum substance concentration is always be given by the capacity of the GC capillary column, resulting in peak saturation and broadening.

This limitation of the generation rate to an absolute maximum value, however, has a limiting effect on the dynamic measuring range. It is therefore better to regulate the generation rate by feedback control, i.e. to control the generation rate dependent on the changes in substance concentration.

The generation rate can be controlled in the familiar manner in two ways: (1) either by feedback control of the intensity (or strength) of the ionization process which is maintained by an electron beam, a photon beam, or by a primary ion beam in the case of secondary ion generation, or (2) by pulsing an ion generation process of constant strength, with feedback control of the pulse duty cycle. In the case of external ion generation, the supply of ions to the ion trap can also be regulated.

Any feedback control of the ion generation rate needs measurements of the ion generation rate, or measurements of another parameter proportional to the ion generation rate. For this, there are several ways:

(a) The control may be based on a measurement of the ion generation rate based on an independent test spectrum measurement with integration of the spectrum ion current just prior of the mass selective loading process. This measurement of the ion generation rate takes place with non-selective loading of the ions. The time required for this measurement can be comparatively short (a few milliseconds). Both the ionization time and the measuring time can be made very short because for this measurement no mass resolution is required whatsoever and an integrative measurement of the ions is adequate. U.S. Pat. No. 4,771,172 describes a similar method ("prescan") for controlling the space charge in ion traps, as is required for spectrum scanning under adequate mass resolution.

(b) The measurement of the ion generation rate is also possible at the beginning of the ionization phase by generating an ejection signal with a frequency mixture without any gaps, the signal thus being made proportional to the generation rate. This signal is then used for control of the ion generation rate during the subsequent mass selective loading process with a waveform containing frequency gaps.

(c) If only a small portion (up to about 20 percent) of the ions totally generated is to be selectively loaded, the ions ejected by the ecitation process from the ion trap through the exit holes in the end cap electrode opposite the ion detector also constitute a measure for the generation rate, and this ion current can be measured and used for feedback control purposes. This regulation process has the advantage that concentration changes appearing during the selective loading process itself can be correctly controlled.

However, one must take into account the fact that very light-weight ions of the GC carrier gas, or the damping or collision gas of the ion trap, can also be formed in overwhelming numbers which then disturb the measuring process. The collision gas is necessary to damp the oscillations of the ions in the trap and to assemble the ions in a small cloud at the center of the ion trap. The light-weight ions of the carrier or collision gas leave the ion trap immediately after their formation or introduction because they generally do not meet the stability conditions of the ion trap. However, in many ways it is possible to differentiate the ion current of collision gas ions from the ion cent of the substance ions.

If, for example, helium is used as the collision gas, the generation of helium ions can be suppressed due to the high ionization energy of the helium. If the ion generation takes place outside the ion trap, ions of the collision gas are frequently not generated at all. If ions which were generated outside the ion trap are transferred to the ion trap with the aid of linear quadrupole or hexapole fields, ions of the GC carrier gas can easily be removed with the aid of the stability border of these guidance fields. These few examples can easily be expanded by any expert.

(d) If the substances are supplied via coupled separation devices, the concentration of the substances supplied can also be determined from the usual detection processes of these separation devices. These are sometimes performed in series with the mass spectrometer, e.g. by UV absorption detectors, partially in parallel to the mass spectrometer by splitting the carrier gas flow. From these concentration values it is possible, after calibration, to obtain ion generation rates with adequate accuracy.

(e) If it is known that the number of mass selected ions always constitutes a certain ratio with respect to the total number of generated ions, the selected ions, their product ions, or their daughter ions from previous measurements can also be applied as feedback parameter for regulation purposes. In any case where mass selected ions from pure substances are loaded, and the mass spectra of the substances are known, the ratio of the selected ions to the total ions formed is known. It is therefore frequently sufficient to take the quantity of the selected ions measured in a preceding scan, multplied by the known ratio, as feedback parameter. A nonlinear extrapolation of more than one previous measurements is also possible to estimate the concentration trend.

(f) If one only knows from the analytical task that the selected ions do not fall below a certain fraction of all ions generated, a regulation of the maximum limit can be derived.

In addition to the control of the ion generation rate, the final population of ions inside the ion trap has also to be controlled. If the ratio of selected ions with respect to the total ions formed is known, the two control processes may combine. In all other cases, two independent control processes are necessary. The first control process relates, as described above, to the generation rate of total ions and therefore to the in trap population equilibrium during ion formation and loading; the second control process relates to the final number of selected ions in the ion trap and thus to the population during the spectrum scan. For the second control process the ion quantities can be determined from preceding measurements by trend estimations. The first regulation process must control the generation rate of all ions whilst the second regulation process controls the total generation of selected ions.

DESCRIPTION OF FAVORABLE EMBODIMENTS

Favorable devices and methods for this invention are shown in FIGS. 1 to 4.

Figure 1:
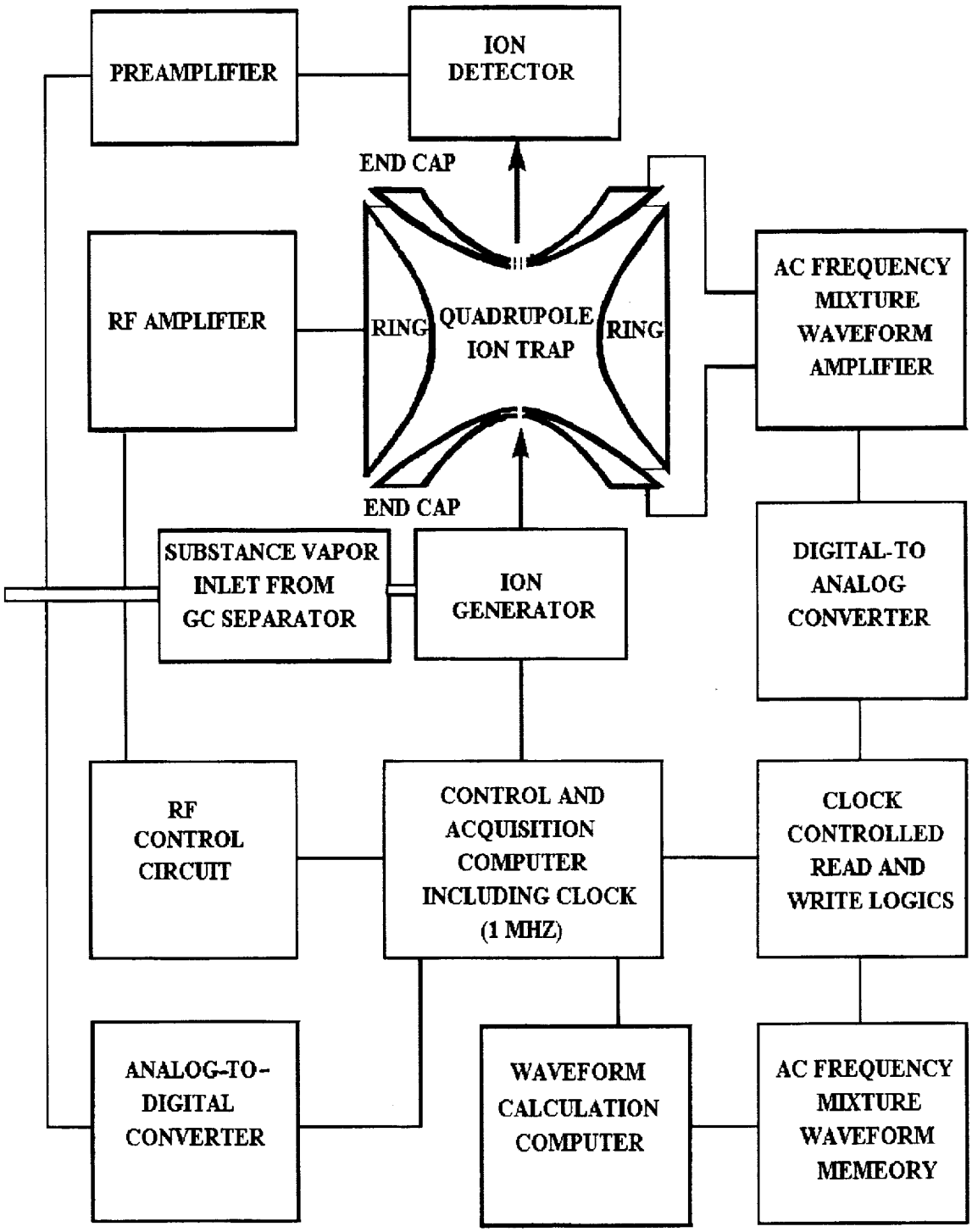
FIG. 1 exhibits a block diagram of a device which can be used for this invention.

FIG. 1 shows a configuration as can be used for outputting the frequency mixture to an RF ion trap after Wolfgang Paul. Via the ring electrode the ion trap is supplied with an RF storage field the necessary drive voltage of which is generated by an RF control circuit and an RF amplifier. The frequency of the RF drive voltage is controlled by a clock generator, usually the frequency amounts to roughly one megahertz. The RF field inside the ion trap, generated by the RF drive voltage, permits storage of ions with masses above a cut-off mass which depends linearly on the amplitude of the RF drive voltage.

An ion generator serves to generate ions of the admixed substance vapors during the ionization phase. The ions can be generated in the ion generator itself, as is here the case, and then transferred to the ion trap. The ion generator then operates as an ion source, and the substance vapors are introduced to the ion generator. Substance vapors will be supplied via an inlet system which—in this case—is coupled to the output of a GC separator device which supplies the substances in form of time-separated peaks. Thus the concentrations of the substances in the carrier gas fluctuate from zero to high values and back, the dynamic range between just detectable traces and full concentrations covers usually more than five orders of magnitude.—On the other hand, the ionizer may only produce an ionizing radiation beam which generates the ions in the ion trap itself. In this case the substance vapors are introduced to the ion trap. The ionizing radiation may consist of electrons, photons, or primary ions.

During mass selective loading of ions the amplitude values of the mixture waveform period, which are saved in a digital data memory, are transferred to (written to) a digital-to-analog converter by a read and write logic circuit at a rate derived by the clock generator. The values converted to voltages are then transferred to the two end caps via a waveform amplifier. Since the same clock generator is used for both processes, and either the basic clock frequency or a multiple thereof is used, all side bands of the digital frequency generation coincide with Mathieu side bands of the resonantly excited ion oscillations. No desired ion sees any excitation, neither by direct resonance, nor by sideband resonances, so the unavoidable side bands of digital waveform generation do not disturb the motions of desired ions. The waveform period is then output cyclically as long as necessary.

The sequence of values of the mixture waveform period stored in the digital data memory may be generated in a separate computer, as is shown in this block diagram of FIG. 1, but it may also be calculated in the control computer.

Aside from this representation it is also possible to output the waveform voltage to one ion trap end cap electrode only and to keep the other end cap at ground potential. Then, by comparison with supply from both sides, a dipole field at half the voltage is superimposed with a quadrupole field at half the voltage. The quadrupole field scarcely has any effect so it can be neglected. For the same dipolar excitation effect, the voltage thus has to be doubled.

The generation rate of the ions depends on the partial pressures (or concentrations within the GC carrier gas) of the substances introduced. According to the invention, this ion generation rate has to be controlled. In FIG. 1, the control and acquisition computer controls the ionization process of the ion generator. To control the generation rate either the intensity of a variable ion generation process or the duty cycle of a pulsed ion generation process of constant strength may be controlled. As feedback parameters for control, measurements of the generation rate in directly preceding integrating test spectrum (or "prescan") measurements (in a process shown in FIG. 2), measurements of the ions ejected during mass selective loading via the ion detector (in a process shown in FIG. 3), measurements by external substance concentration measurements, but also measurement results from previous spectrum scans may be used. For most of the methods, the ion detector signal, amplified by an pre-amplifier and digitized by an analog-to-digital converter may be used, not only for the final mass spectrum acquisition, but also for the measurement of the ion generation rate.

Figures 2A, 2B, 2C, 2D:
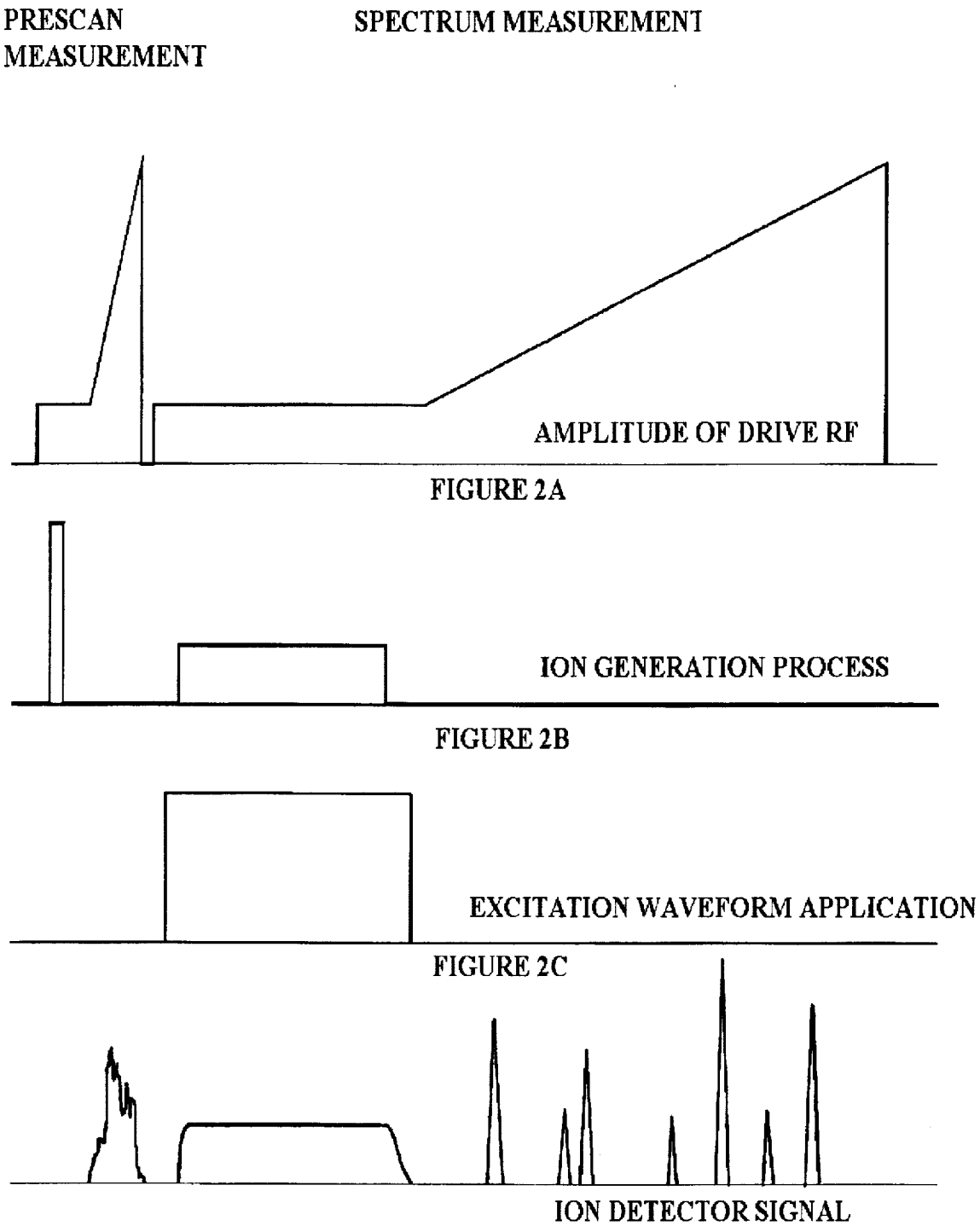
FIGS. 2 and 3 present two time diagrams showing two different methods for the measurement of the ion generation rate for feedback control purposes according to this invention.
Figure 3A:
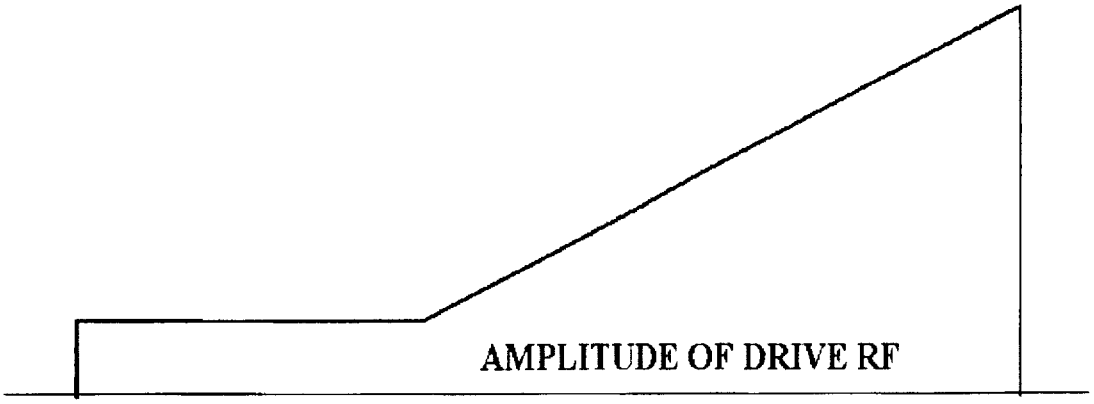
Figure 3B:
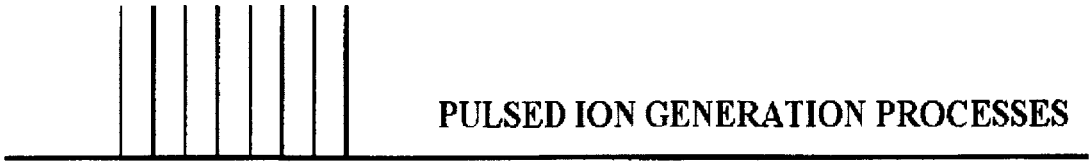
Figure 3C:
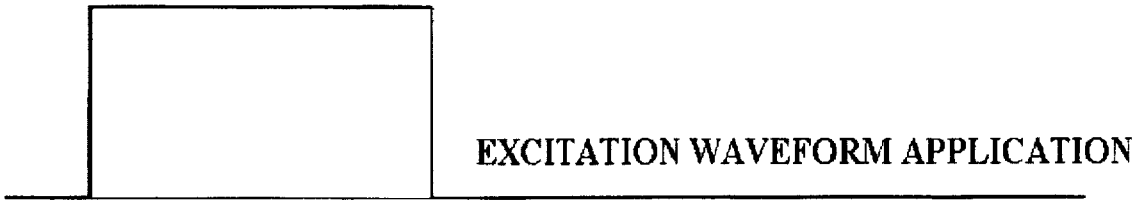
Figure 3D:
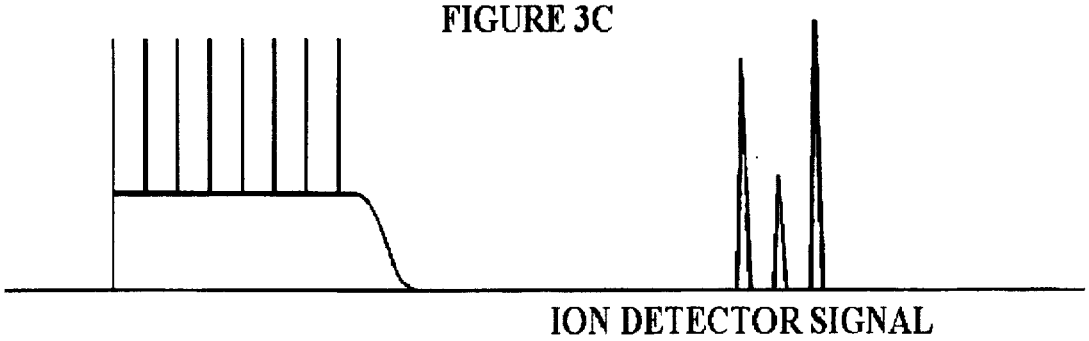
Figure 4A:
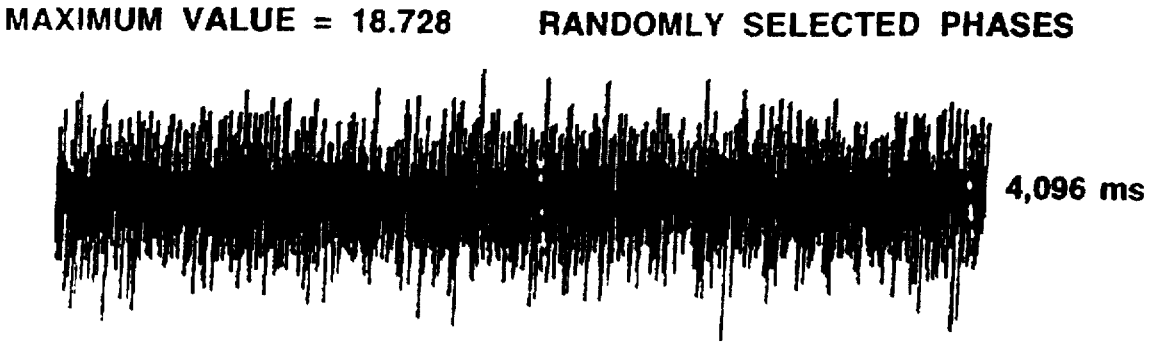
FIG. 4 demonstrates a favorable waveform used for exciting the undesired ions for ejection from the ion trap during ion generation. Track A: Mixture waveform period in the time domaine; Track B: FFT analysis of the waveform period, showing the frequency profile in the frequency domaine; Track C: FFT analysis of the first half of the waveform period; Track F: FFT analysis of the third quarter of the waveform period.
Figure 4B:
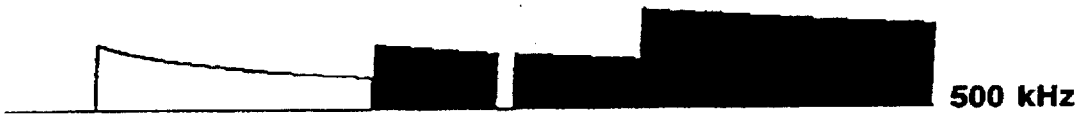
Figure 4C:
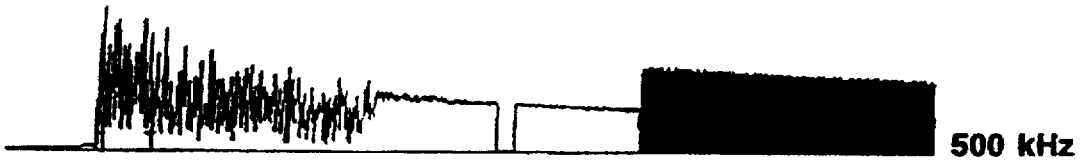
Figure 4D:
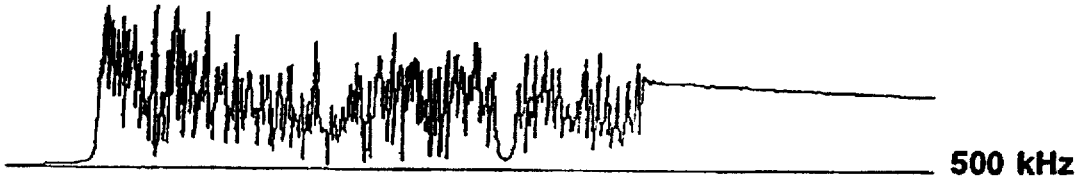

FIG. 2 shows an example of a flow diagram for a spectrum scan with mass selective loading of the ions. The scan consists of a prescan measurement (or integrative test spectrum measurement) to measure the ion generation rate and a final spectrum acquisition with mass selective loading of one or several ion species. The ions storm mass selectively in this case are not processed any further, as soon as they have been stored they are measured as a spectrum. However, any expert is aware of the fact that the ions stored mass selectively, apart from this simplified example, may also be fragmented for measuring daughter ion spectra (or grand-daughter ion spectra), or may be used for forming product ions by chemical ion-molecule reactions in many ways.

The tracks show (A) the course of the RF drive voltage, (B) the ionization process with indication of ionization intensity, (C) the output of the frequency mixture to eject undesirable ions, and (D) the measurement signal of the ion detector with the spectrum of ions mass selectively stored.

The RF drive voltage is set to the same value for both ionization cycles, belonging to the prescan and to the spectrum measurement In both cases, a subsequent linear rise of the RF drive voltage ejects the stored ions mass-sequentially, and the ejected ions are measured by the ion detector. For the prescan measurement with its fast rise this results in a unresolved mass spectrum the integration of which delivers a value representative for the ion generation rate. This is used to control the intensity of the subsequent ionization process for the spectrum measurement During the ionization process of the spectrum measurement, the cyclic output of the frequency mixture waveform period is switched on to remove undesired ions as soon as they are formed. Some of the undesired ions pass the holes in the end cap facing the ion detector, they can be continuously measured by the detector. In a different operating mode from that described above using the prescan measurement, this ejection current can also be used to control the ion generation rate.

FIG. 3 shows a further example of a flow diagram for a spectrum measurement cycle with mass selective storage of the ions. This cycle does not include a prescan measurement to measure the ion generation rate, only the spectrum measurement cycle with mass selective loading of three ion species exists. Here too the ions mass selectively stored are not processed any further but are measured immediately after their loading as a spectrum of the three ion species. The three ion species may be characteristic key ions for a whole series of related substances, e.g. phtalates with different types of residues used as plasticizers, analysed in complex mixtures by GC/MS.

The tracks show (A) the course of the RF drive voltage, (B) an intermittent (pulsed) ionization process, (C) the output of the frequency mixture waveform to eject undesirable ions, and (D) the measurement signal of the ion detector with the ion signal during ionization and ion ejection and the spectrum of the three ion species stored mass selectively.

During the intermittent short ionization process pulses the ions are immediately ejected which cannot be stored in the ion trap because they are lighter than the cut-off mass, e.g. ions of the carrier or collision gas. These ions are ejected within a few microseconds each. They form sharp pulses, the temporal position of which practically coincides with the ionization phases. In between the ionization pulses, the heavier undesired ions are ejected through resonant excitation by the frequency mixture waveform. The level of this ion current in between the ionization pulses is proportional to the ion generation rate of these ions and can therefore be used to feedback control the ion generation rate by changing the ratio of pulse length to pause length.

FIG. 4 shows an example of a computed frequency mixture in a waveform period. It illustrates the particularly favorable case of stepwise changed frequency spacing with compensation of energy density by correspondingly changing the amplitudes in the same steps. The selection of phases was left to the random generator.

Track A shows the amplitude course of the frequency mixture of a full waveform period in the time domaine.

Track B shows the Fourier analysis of the mixture waveform over the entire waveform period in the frequency domaine. Since the FFT analysis is based on a cyclic continuation of the waveform for an indefinite period of time, the frequency spectrum is identical to the frequency definition profile (not shown here) from which mixture waveform A was generated by inverse Fourier transformation (IFFT). In contrast to representations in above mentioned patents which are always based on a constant amplitude, a varying amplitude function was used here for the frequency definition profile where the amplitude was chosen proportional to the square root of mass. Since from 200 kHz upward the frequency spacing was doubled and from 350 kHz it was quadrupled, this range shows frequencies the amplitudes of which fluctuate between zero and full amplitude so that the region appears black because of the lack of graphic resolution. However, the respective stepwise increase of amplitude is visible, superimposed on the functional dependence according to the square root of mass.

Track C shows the Fourier analysis of the left-hand half of the waveform period. Since only every second frequency is shown now by the FFT process (because only half the number of consecutive values are analyzed), at 200 kHz it is only the amplitude jump and not the transition to the graphically unresolved comb structure which is visible. Only from 350 kHz upward does the comb structure becomes visible because here in the frequency profile only one frequency in four is still present Track F shows the Fourier analysis of the third quarter of the frequency interval. Now the FFT process only shows every fourth frequency of the original mixture. The smooth, non-black representation above 350 kHz indicates that the frequencies above 350 kHz are repeatedly output in the mixture interval exactly four times. The light ion masses are thus ejected at a very high rate, firs fly because less transitions to adjacent frequencies are necessary due to the greater frequency spacing, and secondly because the frequency sequence is output four times per mixture interval so four transitions of the further excitation to adjacent frequencies can also take place.

The invention described here is illustrated by a favorable method of storing ions in a Paul RF ion trap, without restricting the invention to that particular case. Adaptions to other purposes and other types of ion traps can easily be performed by any expert in the field.

The simplest embodiment of this invention is a limitation to a maximum generation rate so that the ion trap can never be overloaded dining mass selective loading. This embodiment presupposes that there is a maximum substance concentration. If substances are supplied via chromatographic or electrophoretic capillary separation methods this prerequisite is generally fulfilled because all the separation methods have maximum capacities of their capillary columns. Due to the limited dynamic range of ion detection, however, the detection limit of this method is also restricted by this method of simply restricting the generation rate. It is therefore much more favorable to feedback control the ion generation rate.

A very simple form of controlling the generation rate for ions during mass selective loading is to insert a prescan measurement of the total ion generation rate (as shown in FIG. 2) with a non-selective loading process before each mass selective loading process. However, this method is not particularly time-saving.

As shown in FIG. 2, for the prescan measurement the same voltage of RF drive frequency is set as is selected for the spectrum measurement in order to maintain exactly the same conditions of ion storage. However, for the sample measurement no frequency mixture is applied for the ejection of undesirable ions in order to store all ions generated above the cut-off mass. Ionization time and ionization intensity selected are both relatively small for the sample measurement to prevent the ion trap from being overloaded.

After the ionization phase of the prescan a damping phase is switched on in order to assemble the ions in a small cloud. For the subsequent mass-sequential ejection of the ions it is important that the ion cloud has an optimal small form so that all ions can escape through some perforations located at the center of the end cap in the same proportion as in the spectrum measurement.

The mass-sequential ejection takes place by a linear increase of the RF drive voltage. A very fast increase can be chosen because here the mass resolution of the signals is not important. The current of the ejected ions is measured by the ion detector and integrated before or after digitization. From the integral of the ejected ion current and the known ionization time and intensity the average ion generation rate can be calculated. This ion generation rate is used to feedback control the ion generation rate for the subsequent spectrum measurement cycle.

This method can be improved further by making fast repetitions of prescan and spectrum measurement cycles. From previous prescan measurements a trend in ion generation intensities (or a trend in substance concentrations) can already be calculated by linear or nonlinear extrapolation. This trend calculation can be used to control ionization time and intensity of the prescan measurement so that they are always in the optimal range for the determination of the ion generation rate.

However, under certain conditions it may be advantageous to dispense with prescan measurements if a faster sequence of consecutive measurements is necessary for chromatographic separations, or if time-critical processes of short duration such as flash-pyrolytic ones are analyzed.

If no ions of the carrier or collision gases are generated in the ion trap, the ejected ion current forms a good measure for ion generation during mass selective loading. This current of ejected ions can be measured by the ion detector, and used directly to feedback control the ion generation.

If carrier gas ions are formed, these ions have to be distinguished from heavier ions. Ions of the carrier or collision gas are generally very light in relation to the ions ejected by the frequency mixture waveform. They usually leave the ion trap very fast because they do not see any back-driving forces inside the ion trap, as shown in FIG. 3. On the other hand, they can also be easily removed from the path between the end cap and the ion detector by relatively coarse mass-spectrometric means. Also a removal of the carrier gas ions on the path between ion generation and the ion trap can be used if the ions are generated externally and then transferred to the ion trap. The coarse mass-spectrometric means can consist of weak magnetic fields but also of instabilities of the guidance characteristics of ion-optical transfer elements.

With intermittent ionization in form of short pulses the light ions which are not formed in the stable storage range above the cut-off mass can very easily be distinguished from ejected undesirable ions (see FIG. 3). Ions below the cut-off mass are not stored at all, they do not encounter any backdriving forces. In contrast, their amplitude is increased exponentially by the storage field itself. Their ejection therefore takes place within a few microseconds after their formation or introduction and therefore practically during the ionization pulses themselves. The ions which are ejected by the frequency mixture, on the other hand, need several waveform mixture periods for their ejection in the average, i.e. generally speaking several milliseconds. They largely appear in the intervals between the ionization pulses. By gating the ion detector, or by corresponding time control of a sample-and-hold device, or by computer analysis of the time-dependence of the signal of ejected ions, a measure of the ion generation rate for feedback control purposes can thus be derived.

Furthermore it is possible to use results from preceding scans with mass selective loading of ions to provide feedback parameters for regulating the generation rates. For instance, if the ratio between the undesirable ions and the selected ions is known, signals of the selected ions can be used for control. This ratio is always known, for example, if only a single substance with a known spectrum is admitted to the ion trap, and only one ion species of the spectrum is selectively loaded. If subsequently admitted substances differ, e.g. in the case of chromatographic separation, but are known in principle, as in repeated routine analyses, this method can also be applied. Then, however, it only requires an intelligent method of control and evaluation.

During ion ejection by the frequency mixture waveform, the ion population equilibrium inside the ion trap may generally be much larger than the total number of ions which is permitted for optimal scanning. In experiments, about a factor of 10 was determined four the quotient of the two ion optimum populations. However, this factor depends somewhat on the analytical task and must therefore be adapted to the problem. For this reason it has proved favorable to experimentally calibrate the feedback control method, particularly because the rate measurement does not reflect the complete ion generation rate but only a value proportional to it.

We claim:

1. Method of m/z-selective loading of desired ion species in an ion trap, consisting of the following processes:

(a) generating ions from administered substance vapors inside or outside the ion trap by known methods, (b) in case of external ion generation, transferring of the ions into the ion trap by known ion-optical means, (c) ejecting of all undesired ion species in a known manner by resonant excitation of their oscillations inside the ion trap, during ion generation and loading, by an electrical excitation AC field containing a mixture of discrete frequencies which match the oscillation frequencies of the undesired ion species, (d) controlling the ion generation rate of the ion generation process (a) or the ion transfer rate of the ion transfer process (b) in such a manner that the desired mass resolution of the ejection process (c) remains essentially undisturbed by the space charge of the ion population which is formed as equilibrium of ion generation rate and ion ejection rate.

2. The method as in claim 1, whereby the ion generation rate of process (a) is measured and the measurement value is used for feedback control of the ion generation process (a) or ion transfer process (b).

3. The method as in claim 2, whereby the ion generation rate is measured, just prior to the execution of m/z-selective loading, by an integrative test spectrum measurement with the ion trap using non-selective loading.

4. The method as in claim 2, whereby the ion generation rate of process (a) is determined by measurement of the ion current of the ions ejected by process (c).

5. The method as in claim 2, whereby, during cyclic repetitions of the ion trap measurements, an estimation of the ion generation rate of process (a) is derived from the results of measurements from preceding measurement cycles.

6. The method as in claim 2, whereby the administered substance vapors are separated by a separation device coupled to the ion generator of the ion trap, and the ion generation rate is determined from the substance concentrations, measured in the usual manner by a detector of the separation device.

7. The method as claim 1, whereby the ion generation rate is controlled by controlling the strength of the ion generation process.

8. The method as in claim 1, further comprising the process of applying pulsed ion generation processes of constant strength, wherein the average ion generation rate is controlled by controlling the ratio of the duration of the ionization pulses and the duration of the ionization pauses between the pulses.

9. The method as in claim 1, whereby the final number of m/z-selected ions inside the ion trap is controlled by the controlling of the ion generation rate.

10. The method as in claim 1, whereby the ion generation rate is not regulated but is limited in such a way that for the highest substance concentration to be expected there is just no disturbance in mass resolution of the ejection process of undesirable ions.

* * * * *